US006926306B2

(12) United States Patent
Ward, Jr. et al.

(10) Patent No.: US 6,926,306 B2
(45) **Date of Patent: *Aug. 9, 2005**

(54) REPORT COVER WITH IMPROVED BINDING STRUCTURE AND METHOD OF MAKING SAME

(76) Inventors: Thomas V. Ward, Jr., 412 Ravine Rd., Hinsdale, IL (US) 60521; Jeanne M. Ward, 334 Parkview, Elmhurst, IL (US) 60126

( * ) Notice: Subject to any disclaimer, the term of this patent is extended or adjusted under 35 U.S.C. 154(b) by 0 days.

This patent is subject to a terminal disclaimer.

(21) Appl. No.: 10/751,075

(22) Filed: Jan. 2, 2004

(65) Prior Publication Data

US 2005/0146131 A1 Jul. 7, 2005

(51) Int. Cl.[7] ..... B42D 1/00

(52) U.S. Cl. ..... 281/21.1; 281/15.1; 281/29; 402/70; D19/26; D19/33

(58) Field of Search ..... 281/15.1, 21.1, 281/29, 36–38, 51; 402/70, 73, 80 R; D19/26, D19/33

(56) References Cited

U.S. PATENT DOCUMENTS 4,548,426 A 10/1985 Lockhart
4,706,994 A * 11/1987 Lockhart ..... 281/29
5,713,604 A 2/1998 Ward, Jr.
6,149,200 A 11/2000 Lockhart

* cited by examiner

*Primary Examiner*—Monica S. Carter
(74) *Attorney, Agent, or Firm*—Meroni & Meroni, P.C.; Charles F. Meroni, Jr.; Paul Derek Pressley

(57) ABSTRACT

A one-piece report cover and improved binding structure. The report cover has a front panel, spine and back panel. The improved binding structure comprises a male connector panel, female connector panel and binding element. The female panel has an aperture for receiving and retaining a tab shaped portion of the male panel located between fastening means fastening the female panel to the back panel and a plurality of integrally formed hinges for folding the panel about an edge of a document. The binding element fixes the relationship between the female panel, document and male panel thereby preventing disengagement of the tab portion from the female panel aperture during use. The document may be removed from the improved binding structure by removing the male panel tab portion from the female panel aperture allowing access to the binding element for disassembly. The improved binding structure allows reuse without damage to the components.

17 Claims, 11 Drawing Sheets

Fig. 1
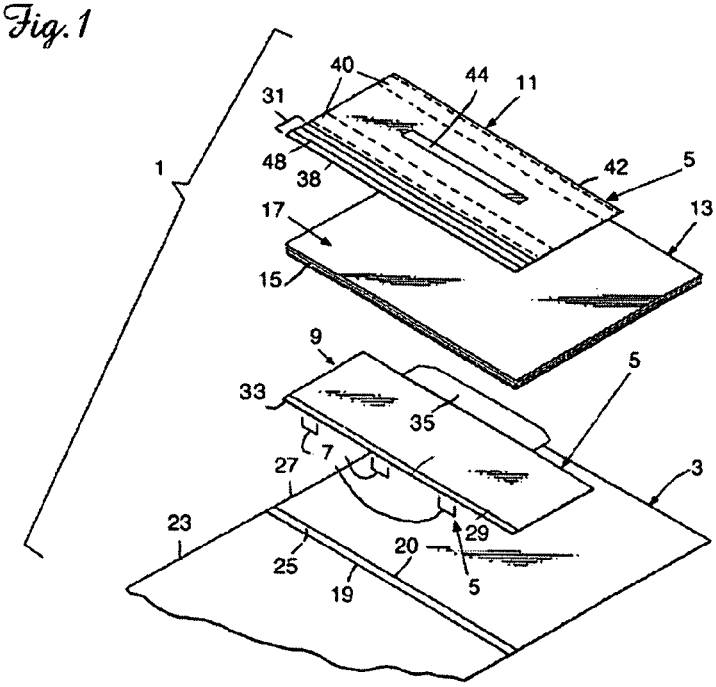
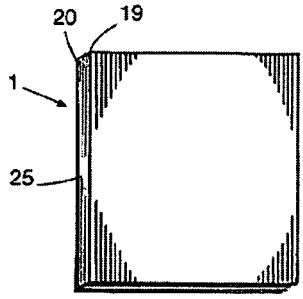
Fig. 2
Fig. 3
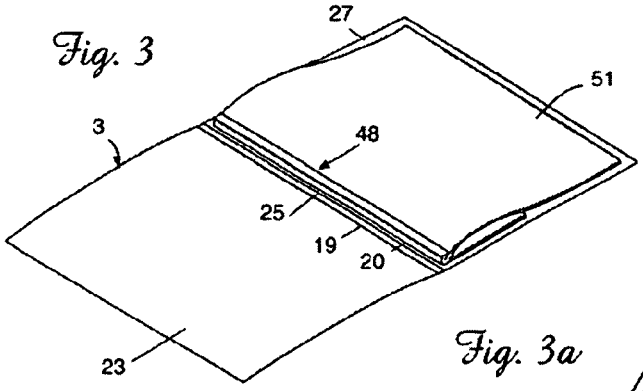
Fig. 3a
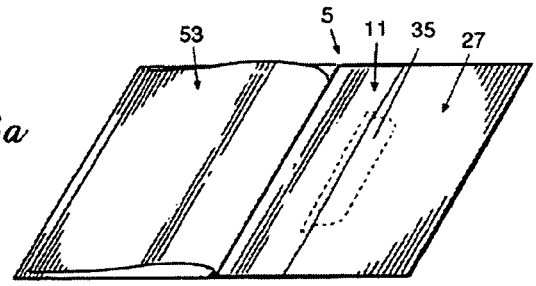

Fig. 24
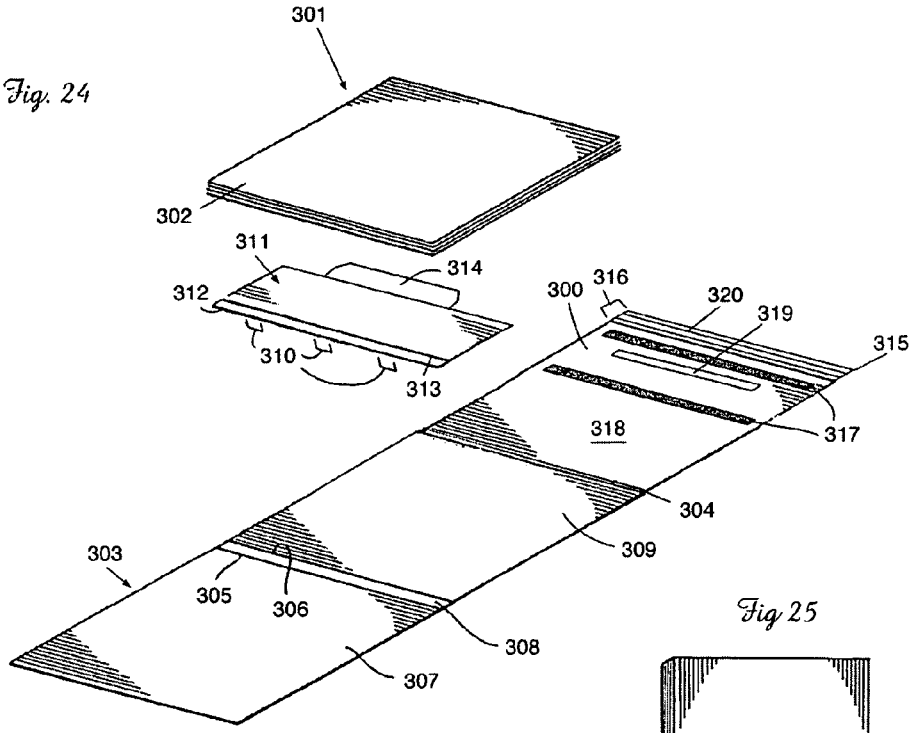
Fig 25
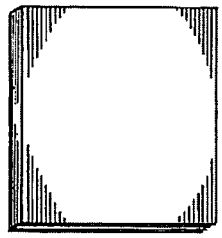
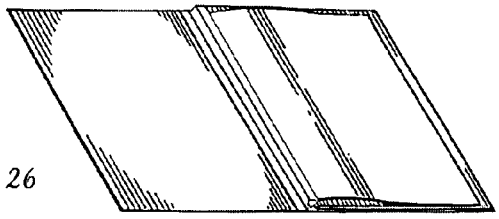
Fig. 26
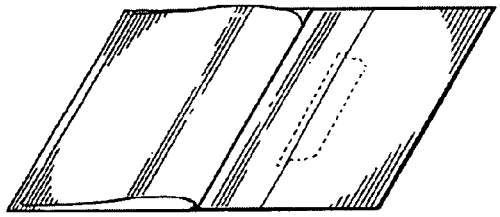
Fig. 27

REPORT COVER WITH IMPROVED BINDING STRUCTURE AND METHOD OF MAKING SAME

BACKGROUND OF THE INVENTION

1. Field of the Invention

The present invention relates to report covers having binding structures for holding sheets of a document together. More particularly, the invention pertains to a binding structure within a report cover providing structure with improved document removability.

2. Description of the Prior Art

Various prior binding devices are known in the art. Permanent binding devices are commonly used to produce hard cover books. Semi-permanent binding devices which use metal or plastic binding structures are commonly used when binding together the internal pages of a document and a front and back cover. A third type of binding is known as loose leaf binding which is typically associated with three-ring binders. There is also one known method for creating a simple binding structure using a "paper and staple" mechanism.

U.S. Pat. No. 4,548,426 issued to Lockhart, discloses a report cover for binding a document. The report cover includes a front panel having three parallel hinges and a rear panel having a single hinge. The sheets of paper making up the report are secured between the front and rear panels near the first edges of the panels by staples. The front panel is then folded about the hinges to lie parallel to and adjacent the rear panel. The front and rear panels are secured along a line distant from the first hinge by an adhesive strip. This device serves to provide a unique binding solution, but it suffers from several disadvantages. The first hinges of each panel permits certain portions of the panels and report to pivot about the hinges to attempt to eliminate any force tending to open or close the report. However, the sheets of the report are connected to the device at an angle that prevents the sheets from laying flat causing a curve or bulge in the document pages. Also, taking the system apart requires tearing the supporting adhesive materials apart, thereby damaging the adhesive materials as well as the report cover itself. The damaged items are not reusable and the disassembly process can be time consuming.

U.S. Pat. No. 6,149,200 issued to Lockhart discloses another device having a full page bound to the back of the report with a binding device, normally plastic or metal. The provided cover is actually a 3-section tri-fold with a flap on the top and bottom of the middle section and a side flap on the end of the right-hand section. The right-hand section folds in to the middle section to create a pocket. The full page then slips inside the pocket loosely holding the report in place. There are several disadvantages to this system. The most prominent is the lack of any true security for the protection of the document. When turned down, the report drops out of the pocket easily. Also, the system is not cost effective, significantly increasing the amount of paper used in the original cover. Cosmetically, it appears awkward and cumbersome. It does not look efficient and, accordingly, not professional.

In working to provide a solution to the problems described in the prior art above, U.S. Pat. No. 5,713,604 was issued for a Paper Binding Structure and Method of Forming Same. In this structure, a connector panel is fastened within a one piece report cover having multiple openings for receiving a binding element which holds sheets of paper therein. This structure achieved the goals of providing a low cost, professional appearing report holding device. However, it is difficult to disassemble an assembled structure of this type. The claimed invention provides an improved structure that allows for easy disassembly without potential damage to the report pages or structural elements of the cover so that the structure may be reassembled for future use.

As will be described in greater detail hereinafter, the binding structure of the present invention differs from the previously proposed invention and employs a number of novel features that render it highly advantageous over the aforementioned prior art.

SUMMARY OF THE INVENTION

Accordingly, it is an object of the claimed invention to provide a binding structure having an improved appearance by virtue of the binding element being concealed by an outer cover.

It is another object of the claimed invention to provide a binding structure which has sheets that lay substantially flat when in an open or closed position to provide a professional appearance, as well as to aid in stacking, mailing and handling.

It is a further object of the claimed invention to provide a cost effective binding structure having an improved appearance that can utilize existing binding equipment.

It is an even further object of the claimed invention to provide a binding structure that requires very little time to assemble and does not dramatically change the binding operation.

Still another object of the claimed invention is to provide a binding structure that secures and protects a document appropriately and is reusable without causing damage to the cover or any of the binding elements.

To achieve the foregoing and other objectives that will become evident after reading this specification and viewing the accompanying drawings, a one-piece report cover with improved binding structure is provided. The cover and binding structure generally comprises a one-piece report cover and an improved binding structure comprising a binding element such as staples or a two pronged fastener, a male connector panel and a female connector panel. A document is held within the improved binding structure during use.

In one embodiment, the improved binding structure is sized and shaped to bind a document along a side margin and be positioned parallel to the hinges of the one-piece report cover that define the front panel, spine panel and a back panel. In another embodiment, the improved binding structure is sized and shaped to bind a document along an end margin and be positioned perpendicular to the hinges of the one-piece report cover.

The male connector panel has a first edge, a male connector panel hinge and a tab shaped portion that is sized and shaped to be retained by the female connector panel. In some embodiment of the claimed invention, the male connector panel has two apertures located between the first edge and the male connector panel hinge for receiving a two pronged fastener binding element.

The female connector panel has a first edge, a series of three parallel female connector panel hinges adjacent the first edge, a pair of adhesive strips attached to the bottom side covered with nonstick protective strips prior to assembly and an aperture positioned between the adhesive strips shaped for receiving the tab shaped portion of the male connector panel. In some embodiments of the claimed invention, the female connector panel has two apertures located between the first edge and the first hinge of the three parallel hinges for receiving a two pronged fastener binding element.

During assembly of the embodiments using staples, a series of staples are placed through the male connector panel between the first edge and the male connector panel hinge, through margin of the document and then through the female connector panel between the first edge and first hinge of the series of three parallel female connector panel hinges.

When using the embodiment having a two pronged fastener as the binding element, the document must have two apertures placed through the sheets of paper to receive the two pronged fastener. During assembly of this embodiment, the two pronged fastener is placed through apertures of the male connector panel, apertures of the sheets of paper and apertures of the female connector panel where the arms of the fastener are bent to lay flat against the document.

These embodiments bind the document within the improved binding structures and dispose the female connector panel on top of the document and the male connector panel beneath the document. The series of three parallel hinges are then manipulated to pivot the female connector panel around the document so that the female connector panel is positioned beneath the male connector panel.

The nonstick protective strips are then removed so that the improved binding structures may be adhesively fastened to the report cover. The tab portion of the male connector panel is then inserted into the aperture of the female connector panel. The claimed invention provides an improved binding structure where the female connector panel has a retention structure in the form of an aperture sized and shaped to retain the tab portion of the male connector panel that removably retains the male connector panel adjacent the female connector panel during use, providing a binding structure with improved appearance. The structural configuration allows access to the binding element without damaging components of the improved binding structure and report cover. A document may be removed from the improved binding structure by pulling up on the male connector panel to remove the tab shaped portion from the aperture in the female connector panel allowing access to the staples for removal.

Other embodiments of the claimed invention integrally form the series of three parallel hinges with the back panel of the report cover instead of being part of the female connector panel. In these embodiments, the female connector panel is adhesively fastened to the back panel of the report cover as previously disclosed and the binding element is used to bind the document and male connector panel to the series of three parallel hinges that are integrally formed with the back panel. The hinges 218, 219 are then manipulated to pivot the document about the back panel positioning the male connector panel above the female connector panel. The tab portion of the male connector panel may then be inserted into the aperture of the female connector panel.

In an even further embodiment of the claimed invention, the female connector panel is integrally formed with the back panel of the one-piece report cover by a hinge. During assembly, the female connector panel can be pivoted about the hinge and then adhesively fastened to the back panel. After the document and male connector panel are bound to the series of hinges and pivoted to lie above the female connector panel, the tab portion of the male connector panel is inserted into the aperture of the female connector panel. In a still further embodiment of the improved binding structure, the female connector panel is integrally connected along a top or bottom edge of the back panel.

BRIEF DESCRIPTION OF THE DRAWINGS

In the drawings:

FIG. 1 is an exploded perspective view of the claimed invention using a series of staples as the binding structure.

FIG. 2 is a perspective view of the claimed invention in a closed position using a series of staples as the binding structure.

FIG. 3 is a perspective view of the claimed invention open to the first page using a series of staples as the binding structure.

FIG. 3A is a perspective view of the claimed invention open to the last page using a series of staples as the binding structure.

FIG. 24 is an exploded perspective view of a still further embodiment where the female connector panel is formed integral with the side edge of the one-piece report cover.

FIG. 25 is a perspective view of the assembled binding structure of FIG. 24 in a closed position.

FIG. 26 is a perspective view of the binding structure of FIG. 24, fully assembled and open to the first page.

FIG. 27 is a perspective view of the binding structure of FIG. 24, fully assembled and open to the last page.

DETAILED DESCRIPTION OF THE PREFERRED EMBODIMENT

Figure 4:
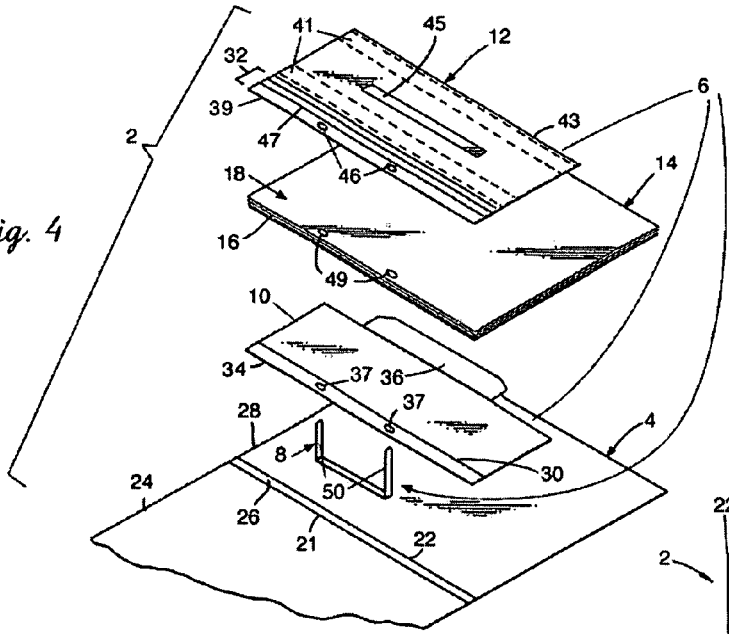
FIG. 4 is an exploded perspective view of the claimed invention using a two-prong metal fastener as the binding structure.
Figure 5:
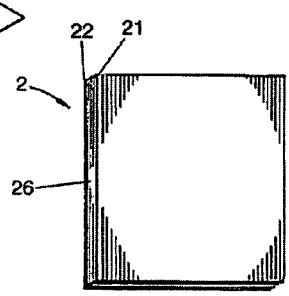
FIG. 5 is a perspective view of the claimed invention in a closed position using a two-prong metal fastener as the binding structure.

Turning now to the drawings, FIGS. 1–6*a* show two preferred embodiment of the one-piece report cover with improved binding structure 1, 2 generally comprising a one-piece report cover 3, 4 and an improved binding structure 5, 6 comprising a binding element such as staples 7 or two pronged fastener 8, a male connector panel 9, 10 and a female connector panel 11, 12. A document 13, 14 typically comprising a plurality of sheets of paper 15, 16 is bound by the improved binding structure 5, 6 within the one-piece report cover 3, 4. The one-piece report cover 3, 4, male connector panel 9, 10 and female connector panel 11, 12 are preferably formed of a stiff paper or cardboard, however, plastic or other materials could also be used.

In the two embodiments shown in FIGS. 1–6*a*, the improved binding structure 5, 6 is sized and shaped to bind a document 13, 14 along a side margin 17, 18 and be positioned parallel to the hinges 19, 20, 21, 22 of the one-piece report cover 3, 4 that define the front panel 23, 24, spine panel 25, 26 and a back panel 27, 28 of the report cover 3, 4. The hinges 19, 20, 21, 22, 29, 30, 31, 32 created in the report cover 3, 4, male connector panel 9, 10 and female connector panel 11, 12 are made by previously known methods such as creasing or scoring. FIGS. 1–3*a* show the one-piece report cover and improved binding structure 1 where the binding element is a series of staples 7 fastening the male connector panel 9, document 13 and female connector panel 11 together. Alternately, FIGS. 4–6*a* show the one-piece report cover and improved binding structure 2 where the binding element is a two pronged fastener 8.

The male connector panel 9, 10 generally has a first edge 33, 34 a male connector panel hinge 29, 30 and a tab shaped portion 35, 36. The male connector panel 10 shown in FIGS. 4–6*a* has two apertures 37 located between the first edge 34 and the male connector panel hinge 30 for receiving the two pronged fastener 8.

The female connector panel 11, 12 has a first edge 38, 39 a series of three parallel female connector panel hinges 31, 32 adjacent the first edge 38, 39 a pair of adhesive strips 40, 41 attached to the bottom side 42, 43 of the female connector panel 11, 12 covered with nonstick protective strips (not shown) prior to assembly and an aperture 44, 45 through the female connector panel 11, 12 positioned between the adhesive strips 40, 41 shaped for receiving the tab shaped portion 35, 36 of the male connector panel 9, 10. Alternatively, other types of similar fastening means such as VELCRO may be used to fasten the female connector panel 11, 12 to the one-piece report cover 3, 4. The female connector panel 12 shown in FIGS. 4–6*a* has two apertures 46 located between the first edge 39 and the first hinge 47 of the three parallel female connector panel hinges 32 for receiving the two pronged fastener 8.

Figure 8:
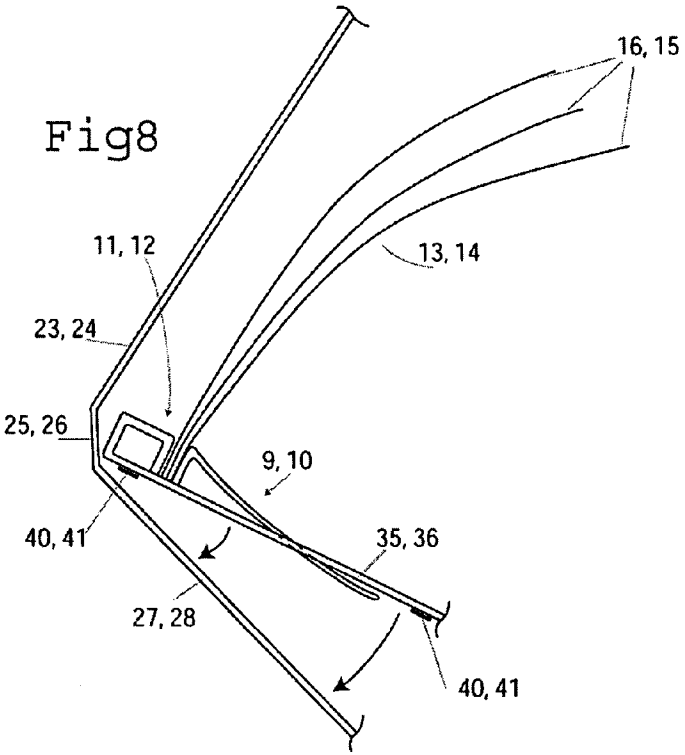
FIG. 8 is a side view of the report bound between the male and female connector panels just prior to final assembly.
Figure 7:
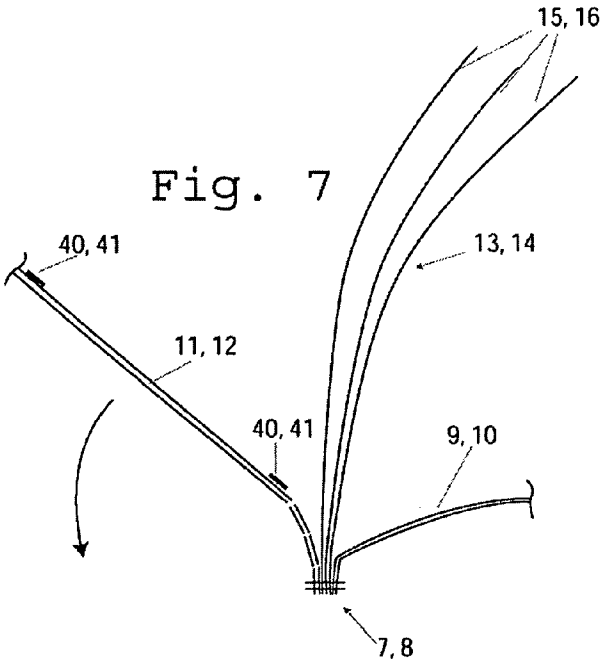
FIG. 7 is a side view of the report bound between the male and female connector panels prior to pivoting around the three-hinge tab for binding.

During assembly of the embodiment shown in FIGS. 1–3*a*, the series of staples 7 are placed through the male connector panel 9 between the first edge 33 and the male connector panel hinge 29 as shown in FIG. 1, through the side margin 17 of the document 13 and then through the female connector panel 11 between the first edge 38 and first hinge 48 of the series of three parallel female connector panel hinges 31 as shown in FIG. 7. This binds the document 13 within the improved binding structure 5 and disposes the female connector panel 11 on top of the document 13 and the male connector panel 9 beneath the document 13. The series of three parallel hinges of the female connector panel 31 are then manipulated to pivot the female connector panel 11 around the document 13 so that the female connector panel 11 is positioned beneath the male connector panel 9 as shown in FIG. 8.

When using an improved binding structure 6 of the type shown in FIGS. 4–6*a*, the document 14 must have two apertures 49 placed through the sheets of paper 16 as shown in FIG. 4 to receive the two pronged fastener 8. During assembly of this embodiment, the two pronged fastener 8 is placed through the two apertures 37 of the male connector panel 10, two apertures 49 of the sheets of paper 16 and two apertures 46 of the female connector panel 12 where the arms 50 of the two pronged fastener 8 are bent to lay flat against the document 14. This binds the document 14 within the improved binding structure 6 and disposes the female connector panel 12 on top of the document 14 and the male connector panel 10 beneath the document 14. The series of three parallel hinges of the female connector panel 32 are then manipulated to pivot the female connector panel 12 around the document 14 so that the female connector panel 12 is positioned beneath the male connector panel 10 as shown in FIG. 8.

Figure 6:
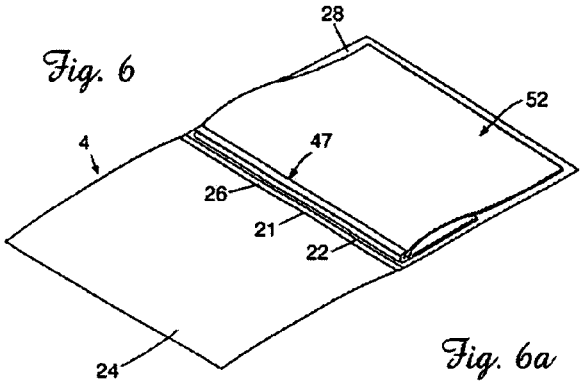
FIG. 6 is a perspective view of the claimed invention open to the first page using a two-prong metal fastener as the binding structure.
Figure 6A:
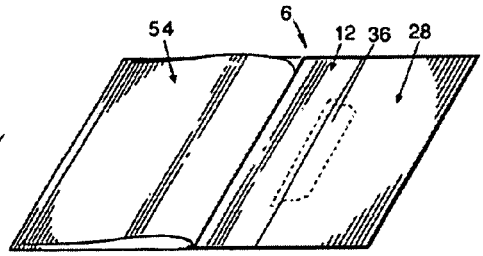
FIG. 6A is a perspective view of the claimed invention open to the last page using a two-prong metal fastener as the binding structure.
Figure 9:
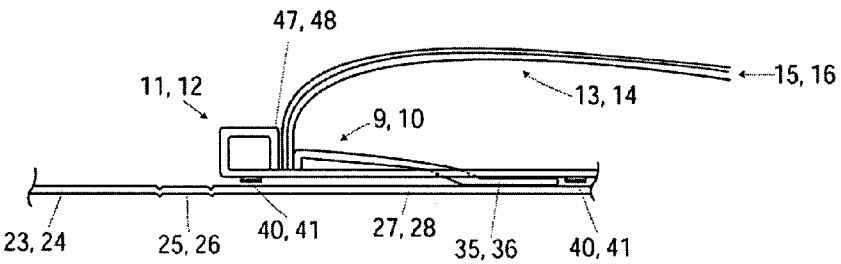
FIG. 9 is a wide angle side view of the claimed invention fully assembled, in an open position.
Figure 10:
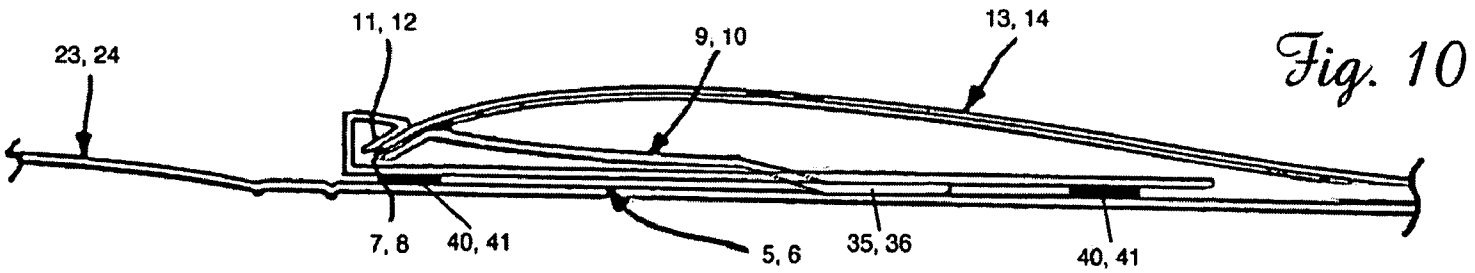
FIG. 10 is a detailed side view of the claimed invention fully assembled, in an open position.
Figure 11:
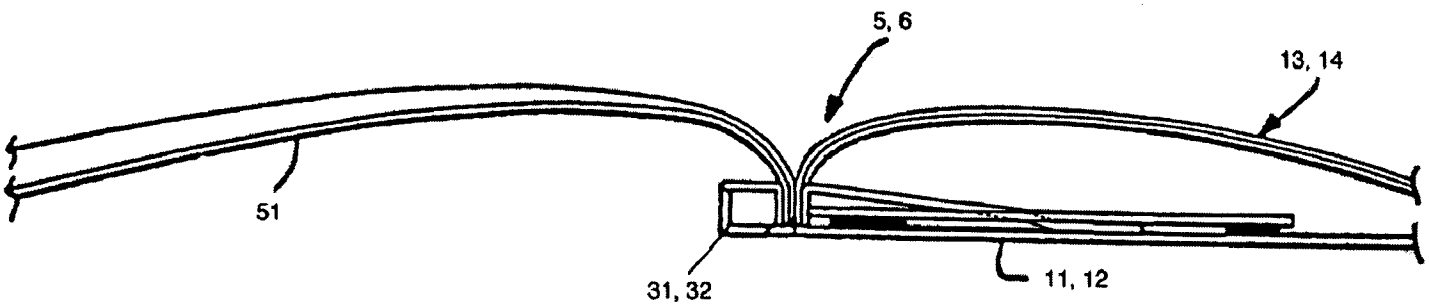
FIG. 11 is a detailed side view of the claimed invention fully assembled, with the pages of the report half open.

The nonstick protective strips 40, 41 are then removed so that the improved binding structures 5, 6 may be adhesively fastened to the one-piece report cover 3, 4 as shown in FIGS. 9–11 by the adhesive strips 40, 41. After the improved binding structures 5, 6 are adhesively fastened to the back panel 27, 28 of the one-piece report cover 3, 4 the tab portion 35, 36 of the male connector panel 9, 10 is inserted into the aperture 44, 45 of the female connector panel 11, 12 as shown in FIGS. 10 and 11. The resulting one-piece report cover with improved binding structure 1 is shown in a closed position in FIG. 2 utilizing staples and 2 in FIG. 5 utilizing a two pronged fastener. FIGS. 3 and 6 show the one-piece report cover with improved binding structure 1, 2 opened to the first page 51, 52 of the document 13 and FIGS. 3*a* and 6*a* show the one-piece report cover with improved binding structure 1, 2 opened to the last page 53, 54 of the document 13, 14.

The claimed invention provides an improved binding structure 5, 6 where the female connector panel 11, 12 has a retention structure in the form of an aperture 44, 45 sized and shaped to retain the tab portion 35, 36 of the male connector panel 9, 10 that removably retains the male connector 9, 10 panel adjacent the female connector panel 11, 12 during use, availing a user of a structure 5, 6 with the benefits of the objects of the claimed invention. This novel structural configuration allows the user to gain access to the binding element without damaging components of the improved binding structure 5, 6 and one-piece report cover 3, 4. For example, in the embodiment shown in FIGS. 1–3*a*, the male connector panel 9 can be disassembled from the female connector panel 11 by the discrete disassembly manipulation of pulling up on the male connector panel 9 thereby removing the tab shaped portion 35 from the aperture 44 in the female connector panel 11, allowing access to the staples 7 for removal when the user desires to remove the document 13 from the improved binding structure 5.

Figure 13:
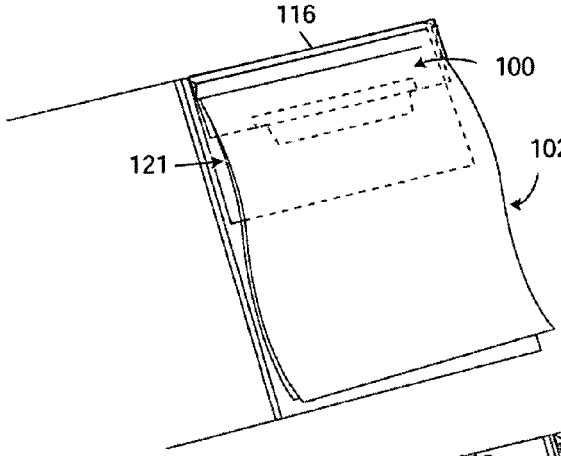
FIG. 13 is a perspective view of the assembled binding structure of FIG. 12.
Figure 13A:
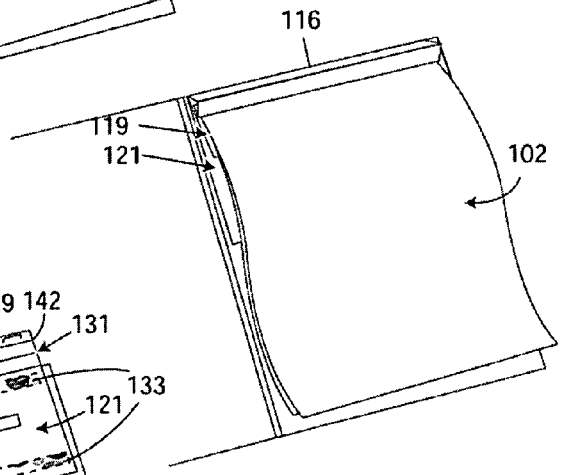
FIG. 13A is another perspective view of the assembled binding structure of FIG. 12.
Figure 12:
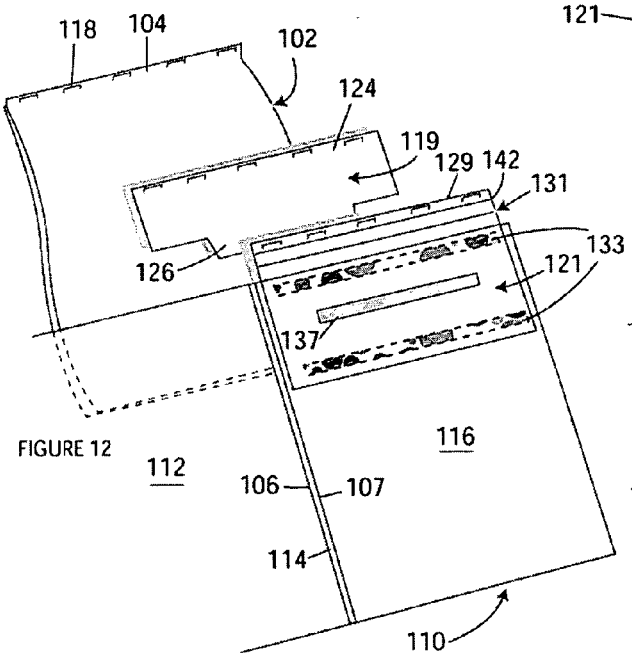
FIG. 12 is an exploded perspective view of another embodiment of the claimed invention where the binding structure binds a report from the top using a series of staples.
Figure 14:
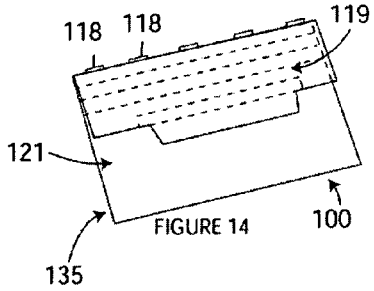
FIG. 14 is a perspective view of components of the binding structure of FIG. 12 prior to assembly.
Figure 16:
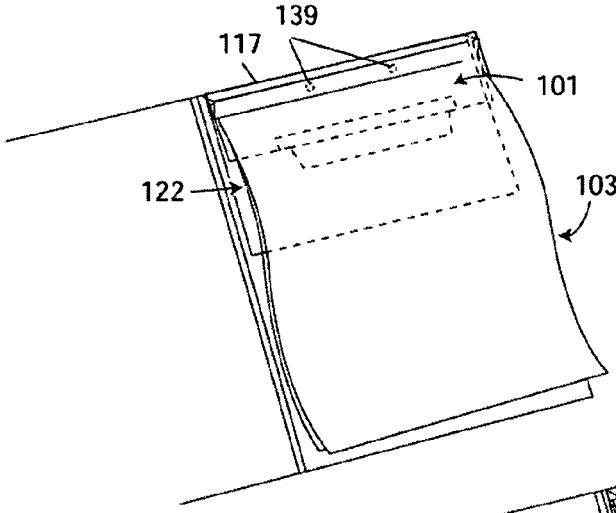
FIG. 16 is a perspective view of the assembled binding structure of FIG. 15.
Figure 16A:
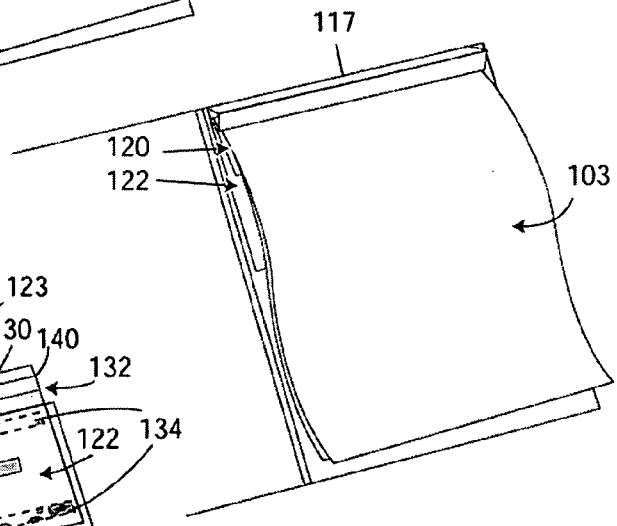
FIG. 16A is another perspective view of the assembled binding structure of FIG. 15.
Figure 15:
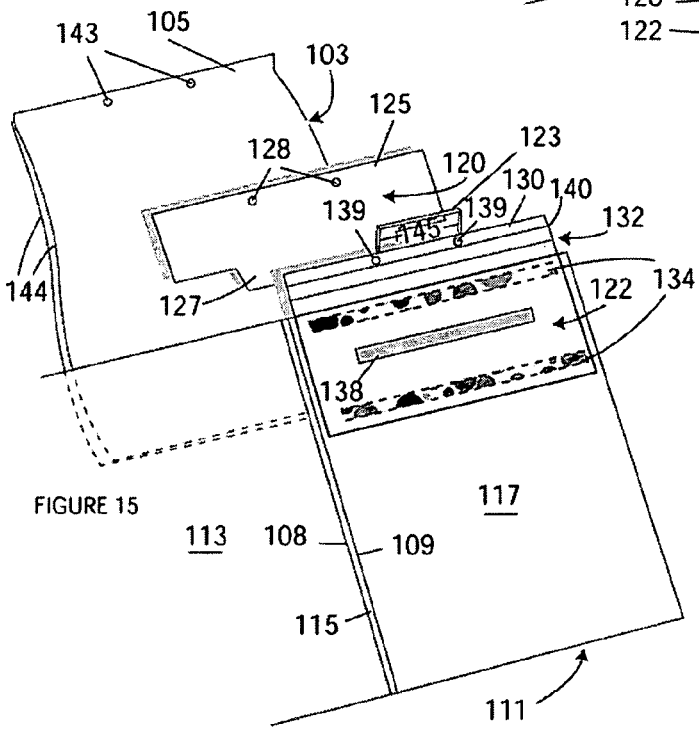
FIG. 15 is an exploded perspective view of another embodiment of the claimed invention where the binding structure binds a report from the top using a two-prong metal fastener.
Figure 17:
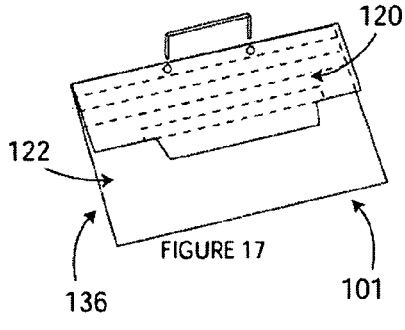
FIG. 17 is a perspective view of components of the binding structure of FIG. 15 prior to assembly.

In the two embodiments shown in FIGS. 12–17, the improved binding structure 100, 101 is sized and shaped to bind a document 102, 103 along an end margin 104, 105 and be positioned perpendicular to the hinges 106–109 of the one-piece report cover 110, 111 that define the front panel 112, 113, spine panel 114, 115 and back panel 116, 117 of the report cover 110, 111. FIGS. 12–14 show the one-piece report cover and improved binding structure 100 where the binding element is a series of staples 118 fastening the male connector panel 119, document 102 and female connector panel 121 together. Alternately, FIGS. 15–17 show the one-piece report cover and improved binding structure 101 where the binding element is a two-pronged fastener 123.

The male connector panel 119, 120 generally has a first edge 124, 125 and a tab shaped portion 126, 127. The male connector panel 120 shown in FIGS. 15–17 has two apertures 128 located adjacent the first edge 125 for receiving the two pronged fastener 123.

The female connector panel 121, 122 has a first edge 129, 130, a series of three parallel female connector panel hinges 131, 132 adjacent the first edge 129, 130, a pair of adhesive strips 133, 134 attached to the bottom side 135, 136 of the female connector panel 121, 122 covered with nonstick protective strips (not shown) prior to assembly and an aperture 137, 138 through the female connector panel 121, 122 positioned between the adhesive strips 133, 134 shaped for receiving the tab shaped portion 126, 127 of the male connector panel 119, 120. Alternatively, other types of similar fastening means such as VELCRO may be used to fasten the female connector panel to the one-piece report cover. The female connector panel 122 shown in FIGS. 15–17 has two apertures 139 located between the first edge 130 and the first hinge 140 of the three parallel female connector panel hinges 132 for receiving the two pronged fastener 123.

During assembly of the embodiment shown in FIGS. 12–14, the series of staples 118 are placed through the male connector panel 119 adjacent the first edge 124 as shown in FIG. 12, through the end margin 104 of the document 102 and then through the female connector panel 121 between the first edge 129 and first hinge 142 of the series of three parallel female connector panel hinges 131 as shown in FIG. 7. This binds the document 102 within the improved binding structure 100 and disposes the female connector panel 121 on top of the document 102 and the male connector panel 119 beneath the document 102. The series of three parallel hinges 131 of the female connector panel 121 are then manipulated to pivot the female connector panel 121 around the document 102 so that the female connector panel 121 is positioned beneath the male connector panel 119 as similarly shown in FIG. 8.

When using an improved binding structure 101 of the type shown in FIGS. 15–17, the document 103 must have two apertures 143 placed through the sheets of paper 144 as shown in FIG. 15 to receive the two pronged fastener 123. During assembly of this embodiment, the two pronged fastener 123 is placed through the two apertures 128 of the male connector panel 120, two apertures 143 of the sheets of paper 144 and two apertures 139 of the female connector panel 122 where the arms 145 of the two pronged fastener 123 are bent to lay flat against the document 103. This binds the document 103 within the improved binding structure 101 and disposes the female connector panel 122 on top of the document 103 and the male connector panel 120 beneath the document 103. The series of three parallel hinges of the female connector panel 132 are then manipulated to pivot the female connector panel 122 around the document 103 so that the female connector panel 122 is positioned beneath the male connector panel 120 as similarly shown in FIG. 8.

The nonstick protective strips are then removed so that the improved binding structure 100, 101 can be adhesively fastened to the one-piece report cover 110, 111 as similarly shown in FIGS. 9–11, with the orientation of the improved binding structure 100, 110 being rotated 90 degrees. Alternatively, other types of similar fastening means such as VELCRO may be used to fasten the female connector panel to the one-piece report cover. After the improved binding structure 100, 101 is adhesively fastened to the back panel 116, 117 of the one-piece report cover 110, 111, the tab portion 126, 127 of the male connector panel 119, 120 is inserted into the aperture 137, 138 of the female connector panel 121, 122 as similarly shown in FIGS. 10 and 11.

Figure 19:
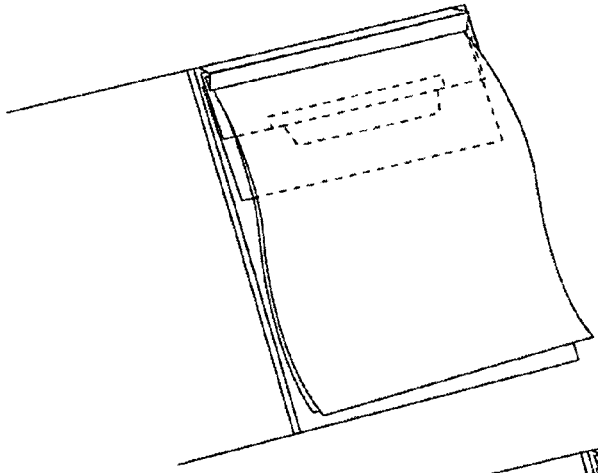
FIG. 19 is a perspective view of the assembled binding structure of FIG. 18.
Figure 19A:
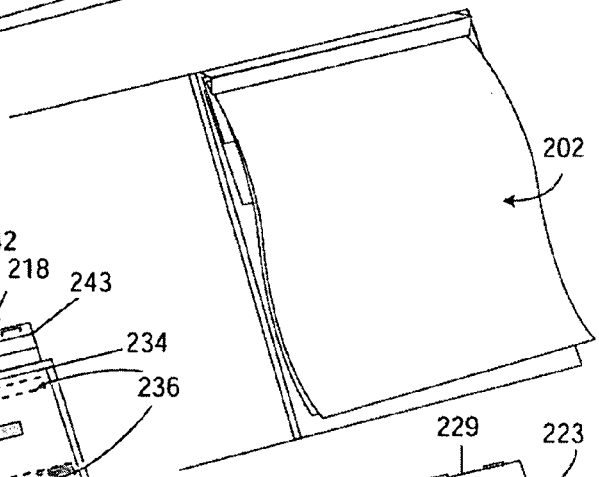
FIG. 19A is another perspective view of the assembled binding structure of FIG. 18.
Figure 18:
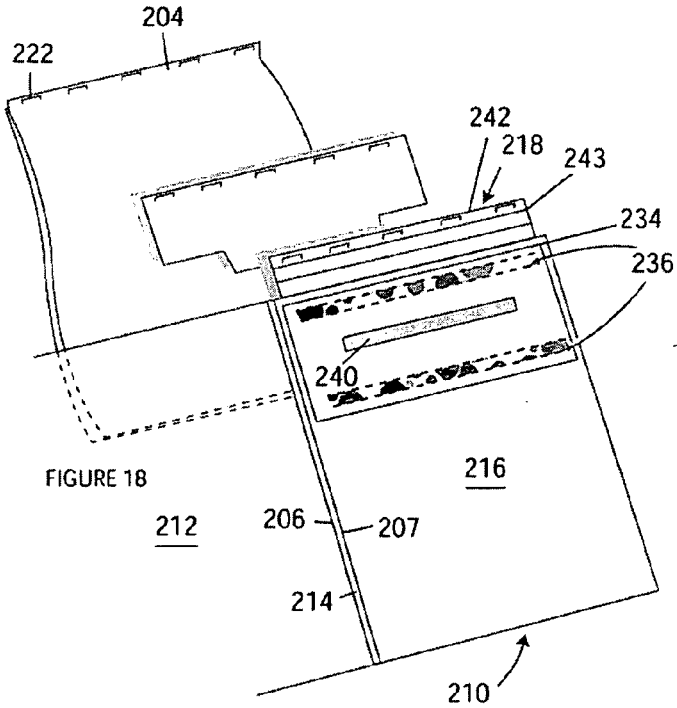
FIG. 18 is an exploded perspective view of yet another embodiment of the claimed invention where the three hinge portion is integrated into the back panel of the one-piece report cover.
Figure 20:
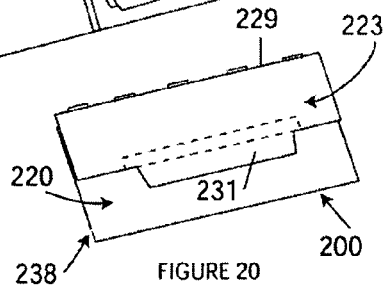
FIG. 20 is a perspective view of components of the binding structure of FIG. 18 prior to assembly.
Figure 21:
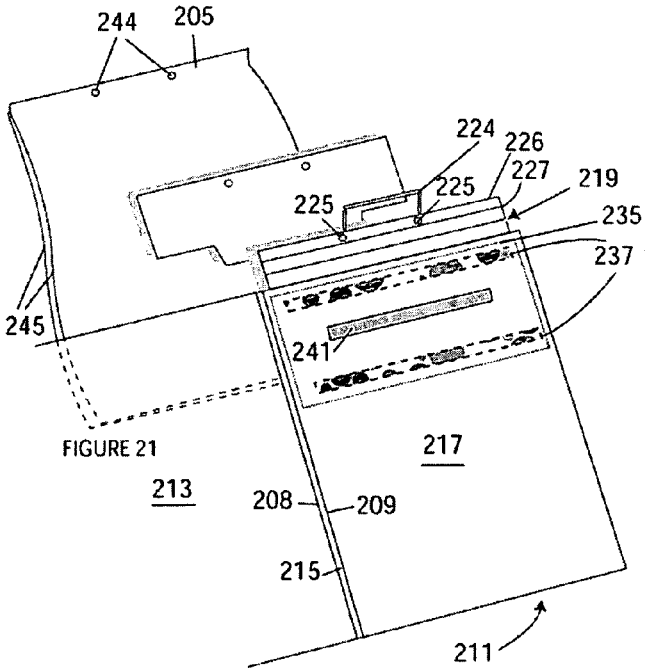
FIG. 21 is an exploded perspective view of yet another embodiment of the claimed invention where the three hinge portion is integrated into the back panel of the one-piece report cover.

In the two embodiments shown in FIGS. 18–23, the improved binding structure 200, 201 is sized and shaped to bind a document 202, 203 along an end margin 204, 205 and be positioned perpendicular to the hinges 206–209 of the one-piece report cover 210, 211 that define the front panel 212, 213, spine panel 214, 215 and back panel 216, 217 of the report cover 210, 211. However, these embodiments differ from those shown in FIGS. 12–17 in that the series of three parallel hinges 218, 219 are integrally formed with the back panel 216, 217 of the report cover 210, 211 as shown in FIGS. 18 and 21 instead of being part of the female connector panel 220, 221 as previously shown in FIGS. 12 and 15.

Figure 22:
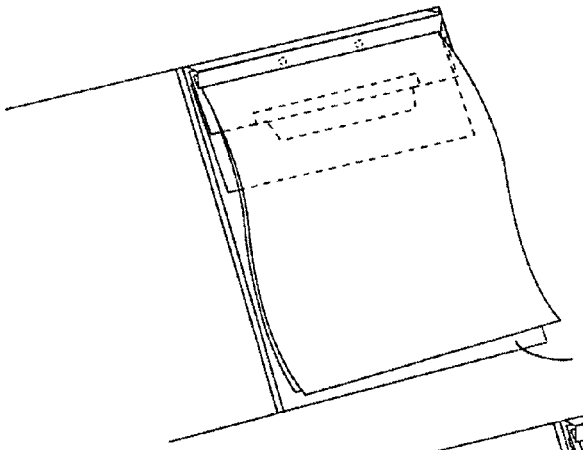
FIG. 22 is a perspective view of the assembled binding structure of FIG. 21.
Figure 22A:
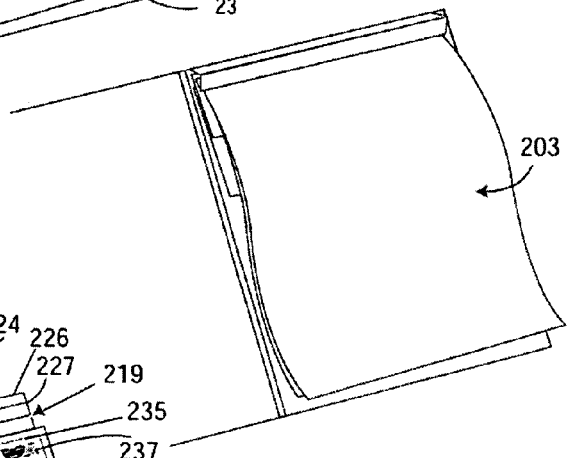
FIG. 22A is another perspective view of the assembled binding structure of FIG. 21.
Figure 23:
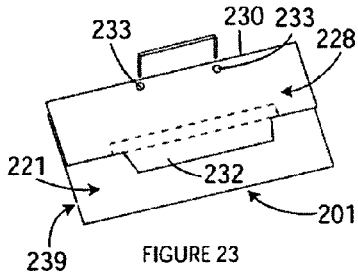
FIG. 23 is a perspective view of components of the binding structure of FIG. 21 prior to assembly.

FIGS. 18–20 show the one-piece report cover 210 and improved binding structure 200 where the binding element is a series of staples 222 fastening the male connector panel 223, document 202 and female connector panel 220 together. Alternately, FIGS. 21–23 show the one-piece report cover 211 and improved binding structure 201 where the binding element is a two-pronged fastener 224. The series of three parallel hinges 219 integrally formed with the back panel 217 in FIG. 21 has two apertures 225 located between the first edge 226 and the first hinge 227 of the series of three parallel hinges 219.

The male connector panel 223, 228 generally has a first edge 229, 230 and a tab shaped portion 231, 232. The male connector panel 228 shown in FIGS. 21–23 has two apertures 233 located adjacent the first edge 230 for receiving the two pronged fastener 224 binding element.

The female connector panel 220, 221 has a first edge 234, 235, a pair of adhesive strips 236, 237 attached to the bottom side 238, 239 of the female connector panel 220, 221 covered with nonstick protective strips (not shown) prior to assembly and an aperture 240, 241 through the female connector panel 220, 221 positioned between the adhesive strips 236, 237 shaped for receiving the tab shaped portion 231, 232 of the male connector panel 223, 228. Alternatively, other types of similar fastening means such as VELCRO may be used to fasten the female connector panel to the one-piece report cover.

During assembly of the embodiment shown in FIGS. 18–20, the series of staples 222 are placed through the male connector panel 223 adjacent the first edge 229 as shown in FIG. 18, through the end margin 204 of the document 202 and then through the series of three parallel hinges 218 integrally formed with the back panel 216 between the first edge 242 and first hinge 243. This binds the document 202 within the improved binding structure 200 and disposes the male connector panel 223 beneath the document 202.

When using an improved binding structure 201 of the type shown in FIGS. 21–23, the document 203 must have two apertures 244 placed through the sheets of paper 245 as shown in FIG. 21 to receive the two pronged fastener 224. During assembly of this embodiment, the two pronged fastener 224 is placed through the two apertures 233 of the male connector panel 228, two apertures 244 of the sheets of paper 245 and two apertures 225 located between the first edge 226 and the first hinge 227 of the series of three parallel hinges 219. This binds the document 203 within the improved binding structure 201 and disposes the male connector panel 228 beneath the document 203.

The nonstick protective strips (not shown) are then removed so that the female connector panel 220, 221 can be adhesively fastened to the one-piece report cover 210, 211 as similarly shown in FIGS. 9–11. The series of three parallel hinges 218, 219 are then manipulated to pivot the document 202, 203 about the back panel 216, 217 positioning the male connector panel 223, 228 above the female connector panel 220, 221. The tab portion 231, 232 of the male connector panel 223, 228 is then inserted into the aperture 240, 241 of the female connector panel 220, 221 as similarly shown in FIGS. 10–11.

In the embodiment shown in FIGS. 24–29, the female connector panel 300 is sized and shaped to bind a document 301 along a side margin 302 and is integrally formed with the one-piece report cover 303 by a hinge 304 oriented parallel with the hinges 305, 306 defining the front panel 307, spine panel 308 and back panel 309 as shown in FIG. 24. The binding element shown in FIG. 24 is a series of staples 310. However, other types of binding elements may be used, such as a two pronged fastener or flexible multiple ring binder.

The male connector panel 311 generally has a first edge 312, a male connector panel hinge 313 and a tab shaped portion 314. The female connector panel 300 has a first edge 315, a series of three parallel female connector panel hinges 316 adjacent the first edge 315, a pair of adhesive strips 317 attached to the bottom side 318 of the female connector panel 300 covered with nonstick protective strips (not shown) prior to assembly and an aperture 319 through the female connector panel 300 positioned between the adhesive strips 317 shaped for receiving the tab shaped portion 314 of the male connector panel 311. Alternatively, other types of similar fastening means such as VELCRO may be used to fasten the female connector panel 300 to the one-piece report cover 303.

Figure 28:
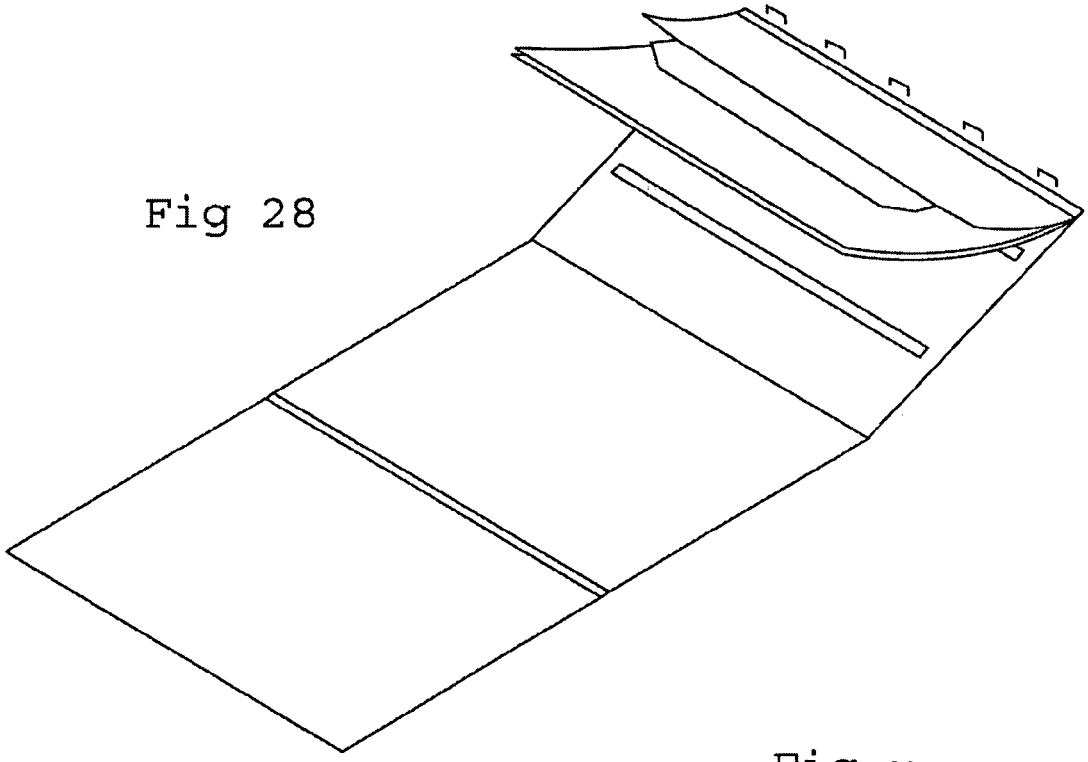
FIG. 28 is a perspective view of the binding structure of FIG. 24 prior to assembly.

During assembly of the embodiment shown in FIGS. 24–29, the series of staples 310 are placed through the male connector panel 311 between the first edge 312 and the male connector panel hinge 313 as shown in FIG. 28, through the side margin 302 of the document 301 and then through the female connector panel 300 between the first edge 315 and first hinge 320 of the series of three parallel female connector panel hinges 316 as similarly shown in FIG. 7. This binds the document 301 within the improved binding structure.

The series of three parallel hinges of the female connector panel 316 are then manipulated to pivot the document 301 and male connector panel 311 about the female connector panel 300 so that the male connector panel 311 lies adjacent the female connector panel 300.

Figure 29:
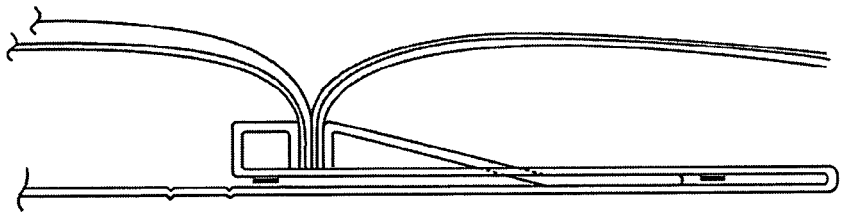
FIG. 29 is an end view of the binding structure of FIG. 24, fully assembled and open to the first page.

The nonstick protective strips are then removed so that the female connector panel 300 can be pivoted about the hinge 304 connecting the female connector panel 300 to the back panel 309 and then adhesively fastened to the back panel 309 of the one-piece report cover 303 as shown in FIG. 29. After the female connector panel 300 is fastened to the report cover 303, the tab portion 314 of the male connector panel 311 is inserted into the aperture 319 of the female connector panel 300 as shown in FIG. 29.

Figure 30:
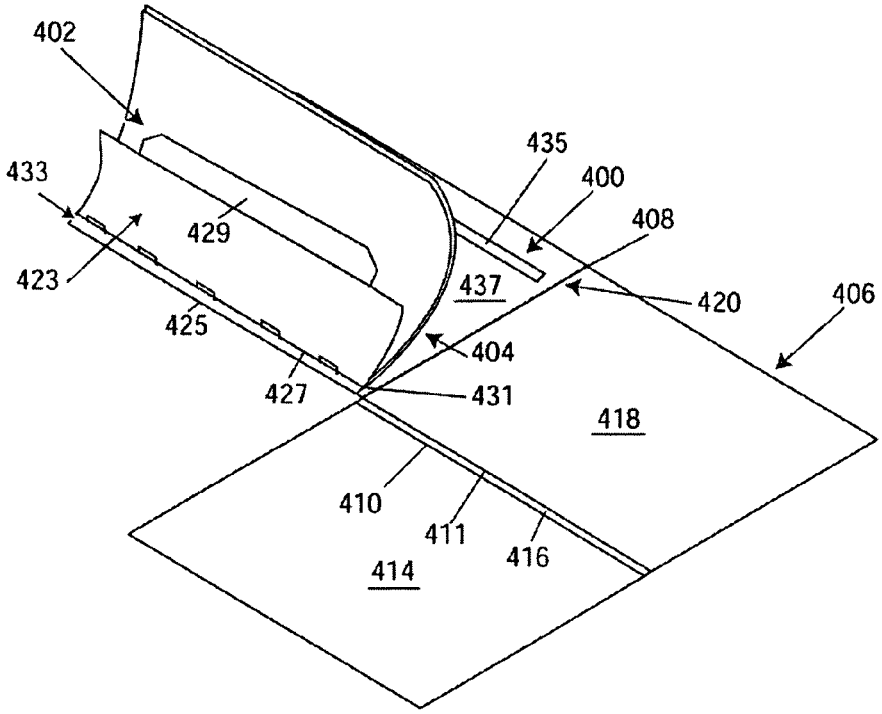
FIG. 30 is an exploded perspective view of another embodiment where the female connector panel is formed integral with the top edge of the one-piece report cover.
Figure 31:
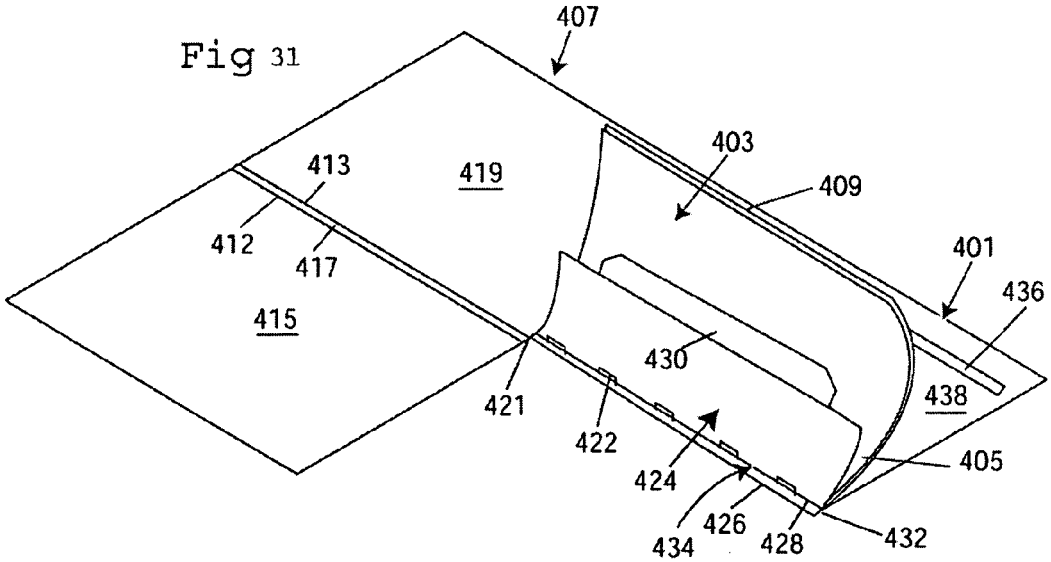
FIG. 31 is an exploded perspective view of another embodiment where the female connector panel is formed integral with the bottom edge of the one-piece report cover.

In the embodiments shown in FIGS. 30 and 31, the female connector panel 400, 401 is sized and shaped to bind a document 402, 403 along a side margin 404, 405 and is integrally formed with the one-piece report cover 406, 407 by a hinge 408, 409 oriented perpendicularly with the hinges 410–413 defining the front panel 414, 415, spine panel 416, 417 and back panel 418, 419 of the report cover 406, 407. FIG. 30 shows an embodiment where the female connector panel 400 is connected along a top edge 420 of the back panel 418 and FIG. 31 shows an embodiment where the female connector panel 401 is connected along the bottom edge 421 of the back panel 419. The binding element shown in FIGS. 30 and 31 are a series of staples 422. However, other types of binding elements may be used, such as a two pronged fastener or flexible multiple ring binder.

The male connector panel 423, 424 generally has a first edge 425, 426, a male connector panel hinge 427, 428 and a tab shaped portion 429, 430. The female connector panel 400, 401 has a first edge 431, 432, a series of three parallel female connector panel hinges 433, 434 adjacent the first edge 431, 432, a pair of adhesive strips 435, 436 attached to the bottom side 437, 438 of the female connector panel 400, 401 covered with nonstick protective strips (not shown) prior to assembly and an aperture (not shown) through the female connector panel 400, 401 positioned between the adhesive strips 435, 436 shaped for receiving the tab shaped portion 429, 430 of the male connector panel 423, 424. Alternatively, other types of similar fastening means such as VELCRO may be used to fasten the female connector panel 400, 401 to the one-piece report cover 406, 407.

During assembly of the embodiments shown in FIGS. 30 and 31, the series of staples 422 are placed through the male connector panel 423, 424 between the first edge 425, 426 and the male connector panel hinge 427, 428, through the side margin 404, 405 of the document 402, 403 and then through the female connector panel 400, 401 between the first edge 431, 432 and first hinge (not shown) of the series of three parallel female connector panel hinges 433, 434 as similarly shown in FIG. 7. This binds the document 402, 403 within the improved binding structure.

The series of three parallel hinges of the female connector panel 433, 434 are then manipulated to pivot the document 402, 403 and male connector panel 423, 424 about the female connector panel 400, 401 so that the male connector panel 423, 424 is adjacent the female connector panel 400, 401.

The nonstick protective strips are then removed so that the female connector panel 400, 401 can be pivoted about the hinge 408, 409 connecting the female connector panel 400, 401 to the back panel 418, 419 and then adhesively fastened to the back panel 418, 419 of the one-piece report cover 406, 407. After the female connector panel 400, 401 is fastened to the report cover 406, 407, the tab portion 429, 430 of the male connector panel 423, 424 is inserted into the aperture 438, 439 of the female connector panel 400, 401 as similarly shown in FIG. 29.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. A one-piece report cover for holding a report document in combination with a binding structure, the combination comprising:

a one-piece report cover having a back panel;

a female connector panel having fastening means for fastening the female connector panel to the back panel of the one-piece report cover at at least two points during use and a plurality of integrally formed hinges positioned parallel to an edge of the female connector panel for folding the female connector panel about an edge of a report document during use;

an aperture through the female connector panel positioned between the two fastened points;

a male connector panel having a tab portion sized and shaped to fit through the aperture of the female connector panel, the aperture removably retaining the tab portion beneath the female connector panel during use providing means for disassembly of the male connector panel by discrete disassembly manipulation; and a binding element for binding the female connector panel, a report document and the male connector panel together during use, the binding element fixing a relationship between the female connector panel, report document and the male connector panel preventing disengagement of the tab portion of the male connector panel from the aperture of the female connector panel during use.

2. The combination of claim 1 wherein the binding element is a plurality of staples.

3. The combination of claim 1 wherein the binding element is a pronged fastener and the male connector panel further comprises a plurality of apertures for receiving prongs of the pronged fastener.

4. The combination of claim 3 wherein the female connector panel further comprises at least one aperture for receiving prongs of the pronged fastener.

5. In a report cover having a front panel, a back panel, a first connector panel fastened to the back panel at at least two points with at least three parallel hinges and a second connector panel for engagement with the first connector panel, wherein the improvement comprises:

an aperture through the first connector panel positioned between the two fastened points; and a tab portion connected to the second connector panel sized and shaped to fit through the aperture of the first connector panel, the aperture retaining the tab portion beneath the first connector panel during use.

6. The improvement of claim 5 wherein a report document is fastened between the first connector panel and the second connector panel by a binding element.

7. The improvement of claim 6 wherein the binding element is a plurality of staples.

8. The improvement of claim 6 wherein the binding element is a pronged fastener and the second connector panel further comprises a plurality of apertures for receiving prongs of the pronged fastener.

9. The improvement of claim 8 wherein the first connector panel further comprises at least one aperture for receiving prongs of the pronged fastener.

10. A one-piece report cover with binding structure for holding a report document, the cover comprising:

a one-piece report cover having a back panel and a three hinged panel foldable about an edge of a report document during use;

a female connector panel having fastening means for fastening the female connector panel to the back panel of the one-piece report cover at at least two points during use;

an aperture through the female connector panel positioned between the two fastened points;

a male connector panel having a tab portion sized and shaped to fit through the aperture of the female connector pane, the aperture retaining the tab portion beneath the female connector panel during use; and a binding element for binding the three hinged panel, a report document and the male connector panel together during use, the binding element fixing a relationship between the three hinged panel, report document and the male connector panel preventing disengagement of the tab portion of the male connector panel from the aperture during use.

11. The cover of claim 10 wherein the binding element is a plurality of staples.

12. The cover of claim 10 wherein the binding element is a pronged fastener and the male connector panel further comprises a plurality of apertures for receiving prongs of the pronged fastener.

13. In a report cover having a front panel, a back panel, a first connector panel fastened to the back panel at at least two points and a second connector panel for engagement with the first connector panel, wherein the improvement comprises:

a three hinged panel integral with the back panel, the three hinged panel foldable about an edge of a report document during use;

an aperture through the first connector panel positioned between the two fastened points; and a tab portion connected to the second connector panel sized and shaped to fit through the aperture of the female connector panel, the aperture retaining the tab portion beneath the female connector panel during use.

14. The improvement of claim 13 wherein a report document is fastened between the three hinged panel and the male connector panel by a binding element.

15. The improvement of claim 14 wherein the binding element is a plurality of staples.

16. The improvement of claim 15 wherein the binding element is a pronged fastener and the second connector panel further comprises a plurality of apertures for receiving prongs of the pronged fastener.

17. A method of making a one-piece report cover with binding structure, the method comprising:

forming a female connector panel with an aperture therethrough and a three hinged portion positioned parallel and adjacent an edge of the female connector panel;

forming a male connector panel with a tab shaped portion sized and shaped for retention by the aperture through the female connector panel;

forming a one-piece report cover with a front panel, spine panel and back panel defined by a plurality of hinges;

binding a document with and between the female connector panel and male connector panel with a binding element, the binding element positioned between the edge of the female connector panel and the three hinged portion;

fastening the female connector panel to the back panel of the one-piece report cover;

pivoting the document and male connector panel about the female connector panel by the three hinged portion;

inserting the tab shaped portion of the male connector panel in the aperture of the female connector panel.

* * * * *